US005097912A

United States Patent [19]

Bowers

[11] Patent Number: 5,097,912

[45] Date of Patent: Mar. 24, 1992

[54] STAKING SYSTEM FOR CONCRETE FORMS

[76] Inventor: Richard H. Bowers, 4401 Oak Forest Dr., Hattiesburg, Miss. 39402

[21] Appl. No.: 696,147

[22] Filed: May 6, 1991

[51] Int. Cl.[5] ..... E02D 7/04

[52] U.S. Cl. ..... 173/90; 173/118; 173/130

[58] Field of Search ..... 173/91, 118, 126, 128, 173/130, 90

[56] References Cited

U.S. PATENT DOCUMENTS

| | | | |
|---|---|---|---|
| D. 261,098 | 10/1981 | Hendon et al. | D8/70 |
| 1,776,521 | 9/1930 | Smith, Sr. et al. | 173/130 |
| 2,629,985 | 3/1953 | McDowell . | |
| 2,742,266 | 4/1956 | Voelkerding . | |
| 3,313,356 | 4/1967 | Clevenger | 173/91 |
| 3,735,822 | 5/1973 | Deike | 173/118 |
| 3,747,690 | 7/1973 | Deike | 173/118 |
| 3,792,739 | 2/1974 | Deike | 173/118 |
| 4,252,472 | 2/1981 | Moraly | 405/244 |
| 4,261,424 | 4/1981 | Gonterman et al. | 173/91 |
| 4,557,409 | 12/1985 | Hecock et al. | 227/147 |

*Primary Examiner*—Douglas D. Watts
*Assistant Examiner*—John M. Husar
*Attorney, Agent, or Firm*—Fleit, Jacobson, Cohn, Price, Holman & Stern

[57] ABSTRACT

An upright guide bar is provided having upper and lower ends and the lower end include structure for releasable engagement with the upper end portion of an upstanding stake to be driver downwardly. A downwardly opening drive housing having upper and lower ends also is provided and the upper end of the guide bar is guidingly telescoped into the lower end of the housing. The lower housing end includes a downwardly facing abutment surface for downward abutting engagement with the stake upper end and the lower end of the housing includes an interior guide sleeve removably mounted therein through which the guide bar is slidingly received, the upper end of the guide bar and the guide sleeve having opposing abutment surface structures limiting upward movement of the housing relative to the guide bar.

16 Claims, 3 Drawing Sheets

STAKING SYSTEM FOR CONCRETE FORMS

BACKGROUND OF THE INVENTION

1. Field of the Invention

This invention relates to a staking system incorporating a stake driver and several different types of stakes. The stake driver is specifically designed to be used in driving short stakes as opposed to long posts and to drive associated stakes in a vertical position, or inclined as desired, without the stake turning relative to the driver.

2. Description of Related Art

Various different forms of posts and stake drivers including some of the general structural and operational features of the instant invention heretofore have been provided. Examples of these previously known forms of drivers are disclosed in U.S. Pat. Nos. 2,629,985, 2,742,266, 3,313,356, 3,735,822, 4,261,424 and 4,557,409. However, these previously known forms of drivers do not include the overall combination of structural and operational features of the instant invention which particularly well adapt the invention for driving short stakes to be used in conjunction with concrete forms and the like.

SUMMARY OF THE INVENTION

The stake driver of the instant invention includes an upright guide bar having upper and lower ends and the lower end includes structure for releasable engagement with the upper end portion of an upstanding stake to be driven downwardly. A downwardly opening driver housing also is provided having upper and lower ends and the lower end of the housing has an impact plate secured thereover having an opening therethrough in which the lower end portion of a guide sleeve disposed within the housing is secured, the guide bar being slidingly received through the guide sleeve and opposed at its upper end through the utilization of a compression spring attached to the upper end of the housing, the upper end of the guide sleeve including an enlarged guide plate supported therefrom slidingly received within the housing and the lower end of the guide bar projecting downwardly below the bottom of the housing sufficient for removable attachment to the upper end of an associated stake.

The main object of this invention is provide a stake driver specifically designed for use in driving relatively short stakes at whatever angle is desired and with the short stakes being coupled to the driver against twisting relative thereto.

Another object of this invention is to provide a stake driver in accordance with the preceding objects and which may be readily disassembled, if desired.

Still another important object of this invention is to provide a stake driver specifically designed to drive stakes by impact with the upper ends thereof and without any portion of the stake being driven projecting up into the housing of the driver.

A further important object of this invention is to provide a plurality of specially designed stakes and stake caps to be used conjunction with the driver of the instant invention.

A final object of this invention to be specifically enumerated herein is to provide a stake driver in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
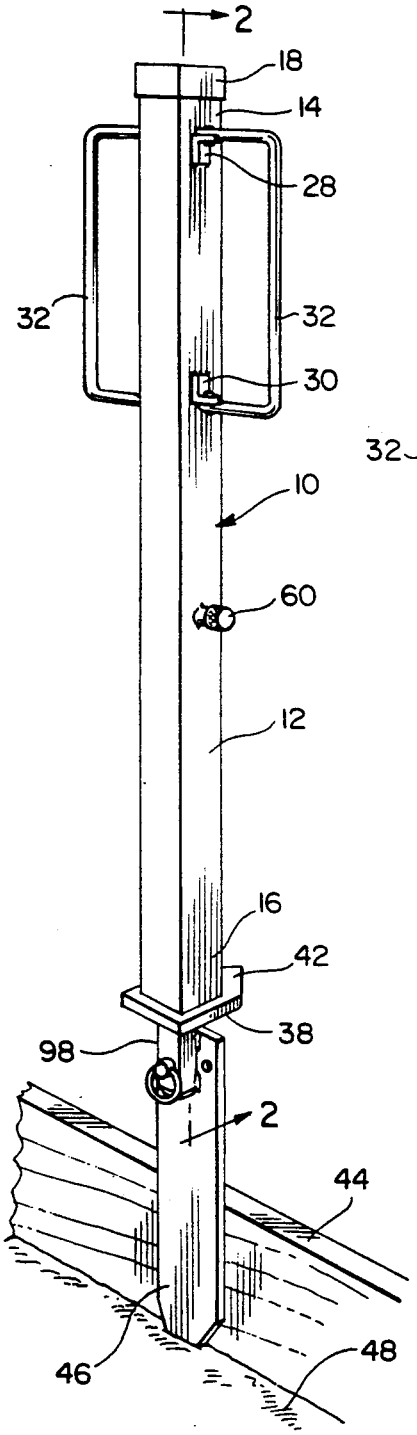
FIG. 1 is a perspective view of the stake driver in operative association with a concrete form stake and in readiness to drive the concrete form stake down into the ground.
Figure 2:
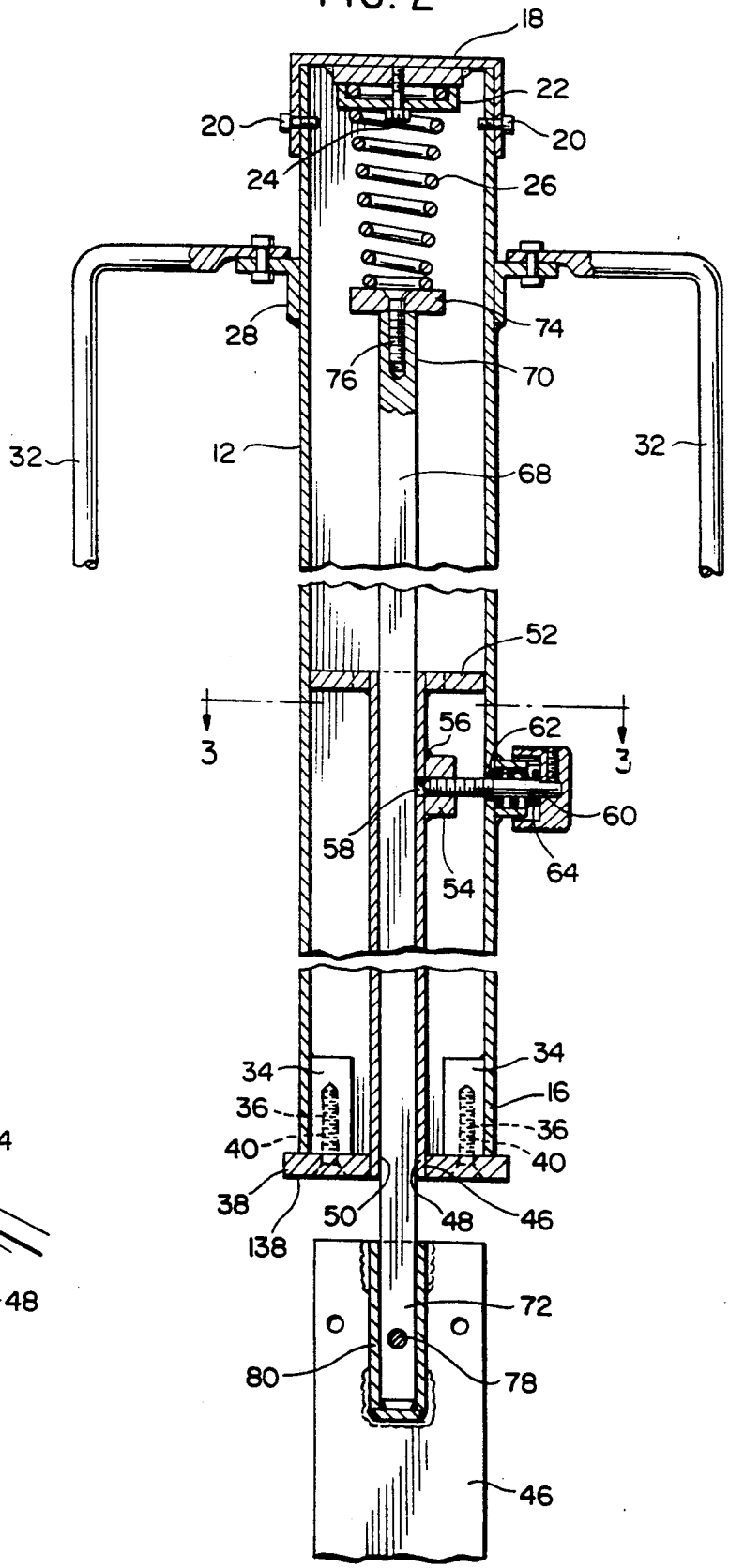
FIG. 2 is an enlarged fragmentary vertical sectional view taken substantially upon the plane indicated by the section line 2—2 of FIG. 1.
Figure 3:
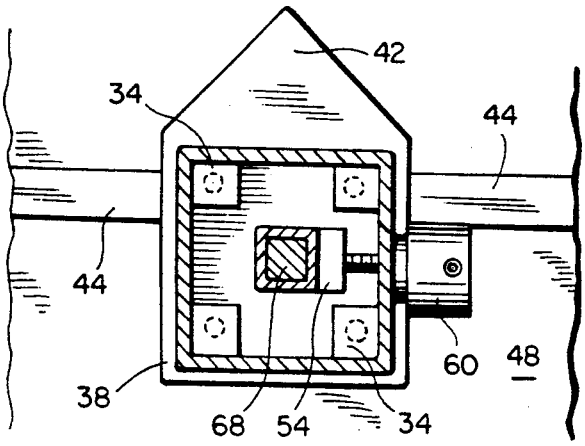
FIG. 3 is a horizontal sectional view taken substantially upon the plane indicated by the section line 3—3 of FIG. 2.

Referring now more specifically to the drawings the numeral 10 generally designates the stake driver of the instant invention. The stake driver 10 includes an upright hollow housing 12 which is substantially square in cross section and includes upper and lower ends 14 and 16. The upper end 14 is removably closed by a cap 18 secured thereover through the utilization of removably fasteners 20 and the inner surface of the cap includes a bracket 22 supported therefrom by a threaded fastener 24, the bracket 22 serving to secure the upper large diameter end of a vertically elongated, tapered compression spring 26 to the underside of the cap 18.

Opposite sides of the housing 12 include outwardly projecting upper and lower brackets 28 and 30 from which opposite side horizontally inwardly opening U-shaped handles 32 are supported and the four corner portions of the interior of the lower end 16 of the housing 12 have vertically elongated mounting blocks 34 secured therein in any convenient manner such as by welding and the mounting blocks 34 include downwardly opening threaded blind bores 36 formed therein.

The lower end 16 of the housing 12 is substantially closed by a lower end plate 38 secured thereover through the utilization of threaded fasteners 40 threadedly engaged in the blind bores 36. The lower end plate 38 projects outwardly beyond all sides of the housing 12 and one marginal edge of the lower end plate 38 defines a V-shaped pointer 42 which may be aligned with any suitable mark (not shown) applied to a form board 44, see FIG. 1, against which a stake 46 is to be disposed during downward driving movement of the stake 46 into the ground 48.

The central area of the lower end plate 38 defines a non-circular aperture or opening 46 therethrough in which the lower end 48 of a non-circular tubular guide sleeve 50 is received. The upper end of the guide sleeve has an enlarge guide plate 52 secured thereto and through which the upper end of the guide sleeve 50 extends. One side of the guide sleeve 52 has a threaded nut 54 welded thereto as at 56 in alignment with a radial bore 58 formed in the guide sleeve 50. A spring biased set screw 60 is sliding received through a bore 62 formed in one side wall of the housing 12 in alignment with the nut 54 and the set screw 60 is threadedly engaged within the nut 54 for support therefrom, the set screw and housing 12 having a compression spring 64 operatively connected therebetween in order to yieldingly bias the set screw 60 outwardly of the bore 62.

When the set screw 60 is threadedly engaged in the nut 54, the guide sleeve 50 is locked in position within the housing 12 against displacement longitudinally thereof. However, the set screw 60 may be unthreaded from the nut 54 and outwardly displaced through the bore 62 in order to allow downward movement of the guide sleeve 50 and guide plate 52 toward the lower end 16 of the housing 12.

A guide bar or rod 68 is provided and includes upper and lower ends 70 and 72. The upper end 70 of the guide rod 68 is disposed within the upper end portion of the housing 12 and has an abutment head 74 removably mounted thereon through the utilization of a removable fastener 76 and lower end of the compression spring 26 is downwardly abutted against the abutment head 74 with the spring 26 only slightly compressed. The guide rod 68 is slidingly received through the guide sleeve 50 and the lower end 72 of the guide rod 68 projects downwardly below the lower end plate 38 and includes a transverse bore 78 formed therein.

Figure 11:
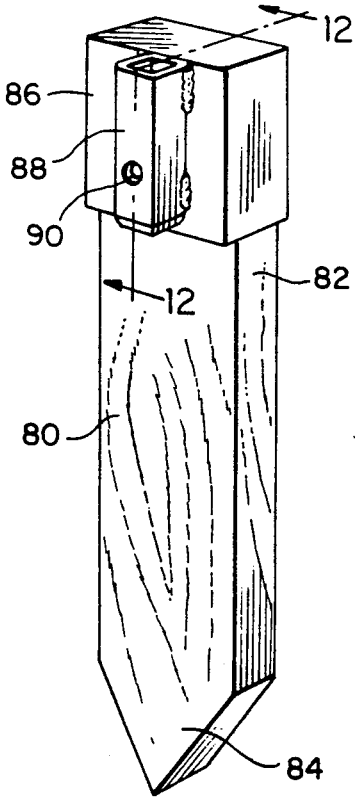
FIG. 11 is a perspective view of a wooden stake provided with an impact cap constructed in accordance with the present invention.
Figure 12:
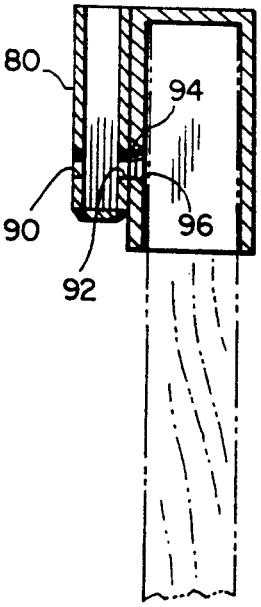
FIG. 12 is a fragmentary vertical sectional view taken substantially upon the plane indicated by the section line 12—12 of FIG. 11 and with the adjacent portion of the wooden stake illustrated in phantom lines.

A wooden stake 80 is illustrated in FIG. 11 including upper and lower ends 82 and 84. A metal, downwardly opening impact cap 86 is telescoped downwardly over the upper end 82 of the stake 80 and includes an upwardly opening socket member 88 secured to one side thereof. The socket member 88 includes registered transverse bores 90 and 92 and the adjoining wall of the cap 86 includes a bore 94 registered with the bores 90 and 92, the inner end of the bore 94 including a conical counterbore 96.

Figure 4:
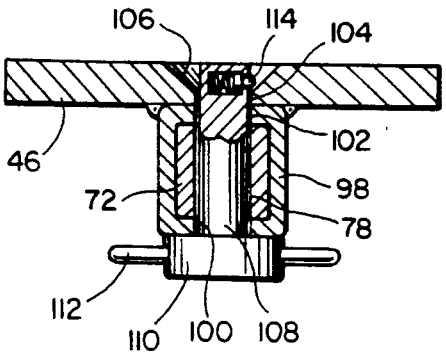
FIG. 4 is an enlarged horizontal sectional view illustrating the releasable connection between the lower end of the guide bar of the stake driver and its releasable mechanical connection with the upper end of an associated concrete form stake.

With attention now invited more specifically to FIG. 4, it may be seen that the stake 46 also includes a socket member 98 mounted therefrom including registered bores 100 and 102 corresponding to the bores 90 and 92. Furthermore, the stake 46 includes a bore 104 corresponding to the bore 94 and the end of the bore 104 remote from the socket member 98 includes a conical counterbore 106 corresponding to the counterbore 96. A locking pin 108 is provided and includes a head 110 on one end thereof equipped with a pivoted pull ring 112. The end of the locking pin 108 remote from the head 100 includes a spring detent 114 projecting into the counterbore 106. Accordingly, the locking pin 108 is releasably retained in position through the bores 100, 78, 102 and 104, thus releasably locking the lower end 72 within the socket member 80, the socket member 80 and the lower end 72 being generally square in cross sectional shape thereby preventing rotation of the stake 46 relative to the guide rod 68. Of course, the lower end 72 may be anchored relative to the socket member 88 of the impact cap 86 in the same manner.

Figure 8:
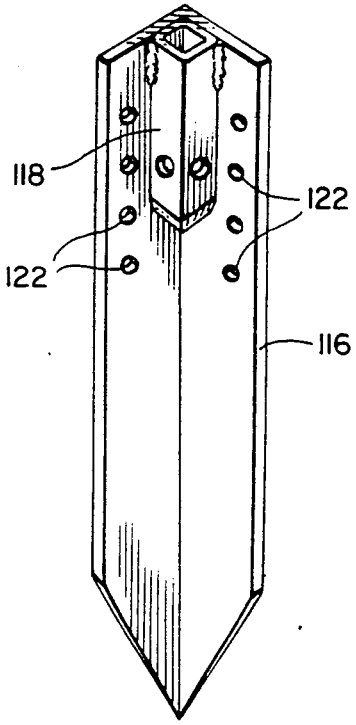
FIG. 8 is a perspective view of an angle member form of stake.

With regard to FIG. 8, a stake is referred to by the reference numeral 116 and comprises an angle member having a socket member 118 secured in the inside corner thereof corresponding to the socket members 80 and 88. In addition, the stake 46 has apertures 120 formed therethrough on opposite sides of the socket member 80 through which fasteners may extend to secure the stake 46 to the form board 44 after the stake 46 has been driven into the ground 48. Further, the stake 116 has a plurality of vertically spaced pairs of bores 122 formed therein corresponding to the bores 120.

Figure 9:
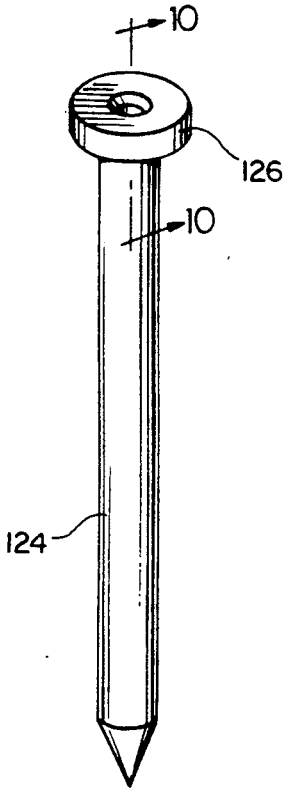
FIG. 9 is a perspective view of a cylindrical form of stake.
Figure 10:
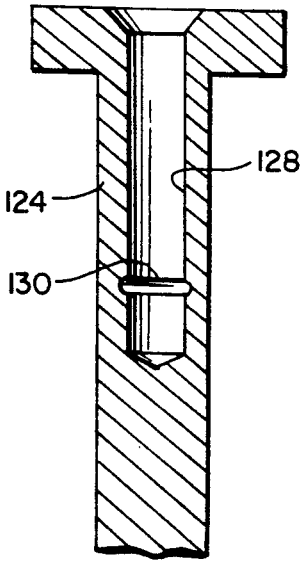
FIG. 10 is an enlarged fragmentary vertical sectional view taken substantially upon the plane indicated by the section line 10—10 of FIG. 9.

With reference now more specifically to FIG. 9 of the drawings, there may be seen a cylindrical form of stake 124 having an enlarged head 126 on its upper end. The head 126 and the upper end of the stake 124 have an upwardly opening blind bore 128 formed therein, a lower portion of the blind bore 128 including a circumferential inwardly opening groove 130.

Figure 6:
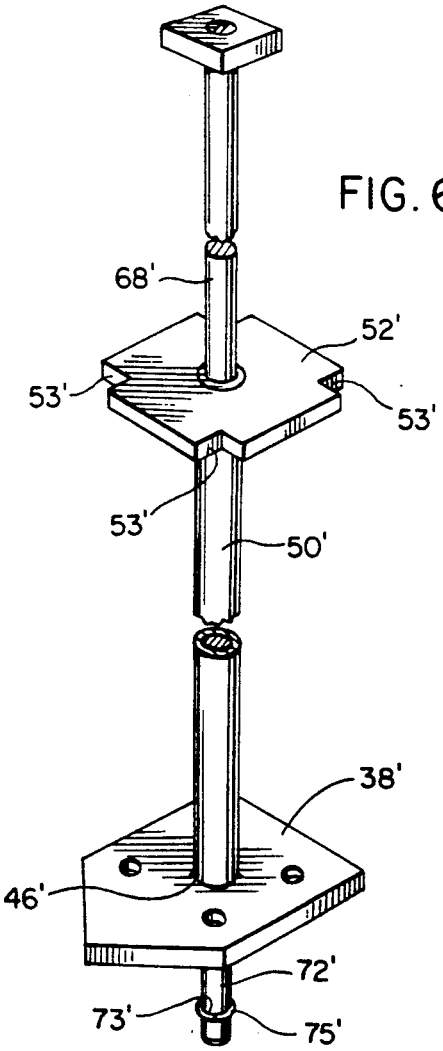
FIG. 6 is a fragmentary perspective view similar to FIG. 5 illustrating a modified form of cylindrical guide bar and cylindrical guide sleeve.
Figure 7:
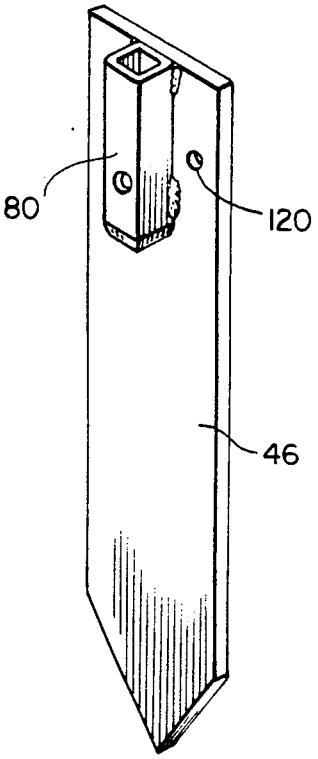
FIG. 7 is a perspective view of a first form of planar form stake to be used in conjunction with the driver of the instant invention.

With reference now more specifically to FIG. 6, there may be seen a modified form of cylindrical guide rod 68' and a cylindrical guide sleeve 50' which may be used in lieu of the guide rod 68 and the guide sleeve 50 when it is desired to drive cylindrical stakes such as the stake 124. In this instance, the lower end 72' of the guide rod 68' includes an outwardly opening circumferential groove 73' in which a split ring 75' is seated, the split ring 75' being receivable within the groove 130 to releasably secure the lower end 72' within the blind bore 128. Of course, the sleeve 50' and guide rod 68' are used in conjunction with a lower end plate 38' corresponding to the lower end plate 38, but including a cylindrical aperture or opening 46' formed therethrough.

Figure 5:
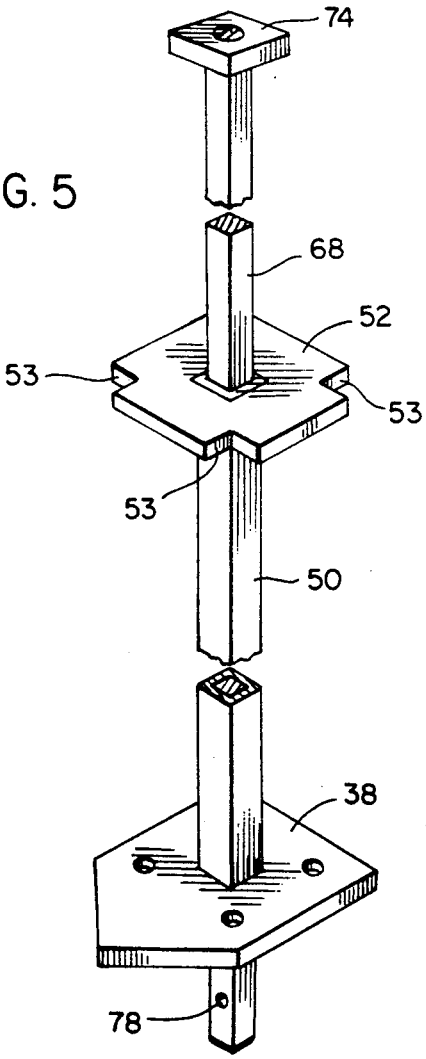
FIG. 5 is an enlarged fragmentary perspective view of the stake driver illustrated in FIG. 1 with the housing removed from the upright guide bar and guide sleeve therefore.

From FIGS. 5 and 6 of the drawings it will noted that the corner portions of the guide plate 52 have notches 53 formed therein, which notches 53 receive the mounting blocks 34 therethrough when the guide sleeve 50, lower end plate 38 and guide plate 52 are downwardly withdrawn from the lower end 16 of the housing 12. Likewise, the guide plate 52' illustrated in FIG. 6 also includes corner notches 53' for receiving the mounting blocks 34 therethrough.

In operation, and with the weight of the housing 12 supported from the compression spring 26, the undersurface 138 of the lower end plate 38 constitutes a downwardly facing abutment surface for engagement with the upper end of the stake 46. However, the surface 138, because the weight of the housing 112 is supported from the guide rod 68 by the spring 26 is spaced slightly above the upper end of the stake 46.

When the housing 12 is raised by the handles 32, upward movement of the housing 12 relative to the guide rod 68 being limited by contact of the underside of abutment head 74 with the upper surface of the guide plate 52, the housing 12 thereafter may be sharply downwardly displaced to impact the surface 138 with the upper end of the stake 46 to drive the latter downwardly into the ground. The lower end 72, by being snugly received within the socket member 80, ensures that the stake 46 will be aligned with the guide rod 68 and the housing 12. In addition, the stake 46 will be prevented against angular displacement relative to the housing 12 about the longitudinal axis thereof during repeated contact of the surface 138 with the upper end of the stake 46 until the latter has been driven into the ground at least substantially flush with the upper surface of the form board 44.

Of course, the stakes 80, 116 and 124 also may be driven into the ground in the same manner, except that when a stake 124 is being driven into the ground it will not be prevented against rotation relative to the housing 12 about the longitudinal axis of the latter.

When it is desired to carry the stake driver 10, the set screw 60 is turned inwardly relative to the nut 54 until the inner end of the set screw 60 is received in the radial bore 58 and tightly engaged against the guide rod 68. In this manner, the driver 10 may be carried without the guide rod 68 slipping further outward from the lower end of the housing 12.

When it is desired to disassemble the stake driver 10, the set screw 160 is removed and the fasteners 40 also are removed, after which the entire assemblage illustrated in FIG. 5 may be downwardly withdrawn from the lower end 16 of the housing 12, the mounting blocks 34 being received through the notches 53.

Instead of using a tubular housing which is square or rectangular in cross section, the tubular housing 12 could be cylindrical and the upper end cap 18 could be threaded onto the exterior of the upper end of such a cylindrical housing. In addition, where a cylindrical housing provided, the lower end plate 38 could comprise the bottom wall of a bottom cap threadedly secured over the lower end of the cylindrical housing. Additionally, the compression spring 26 may be replaced by a block of elastomer material capable of absorbing impact in substantially the same manner as the compression spring 26.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A stake driver including an upright guide bar having upper and lower ends, said lower end including means for releasable engagement with the upper end portion of an upstanding stake to be driven downwardly, a downwardly opening driver housing having upper and lower ends, the upper end of said guide bar being guidingly telescoped upwardly into said housing, said housing lower end including a large area downwardly facing abutment surface means for downward abutting engagement with said stake, said downwardly facing abutment surface means including means defining an aperture therethrough downwardly through which the lower end of said guide bar is slidingly received, said downwardly facing abutment surface means being defined by a lower end plate removably secured over the lower end of said housing and having a small central aperture formed therethrough upwardly through which said guide bar is received, at least the lower end of said housing including a central upstanding guide sleeve removably mounted therein and including upper and lower end portions, said lower end portion being registered with said aperture, said rod being slidingly received through said sleeve, the upper end portion of said guide sleeve including an enlarged guide plate secured thereto slidingly and guidingly received within an intermediate length portion of said housing and upwardly through which said guide bar is slidingly received, and releasable lock means releasably securing said guide sleeve in said housing against axial shifting relative thereto, said bar being of a length to prevent full displacement of said bar into said housing.

2. The stake driver of claim 1 wherein said sleeve is outwardly removable from the lower end of said housing upon removal of said lower end plate from said housing.

3. The stake driver of claim 2 wherein the interior of the lower end of said housing includes mounting blocks spaced therearound, said lower end plate having fasteners passed upwardly therethrough and removably anchored in said blocks.

4. The stake driver of claim 3 where the outer peripheral portions of said guide plate include notches therein through which said mounting blocks are receivable upon withdrawal of said guide sleeve from the lower end of said housing and release of said lock means.

5. The stake driver of claim 4 said lock means including a set screw slidingly received through one side of said housing centrally intermediate its upper and lower ends and threadedly received through the adjacent wall of said guide sleeve and releasably engaged with said guide bar for releasably locking said guide bar in position relative to said guide sleeve.

6. The stake driver of claim 1 wherein said means for releasably engagement with a stake includes means operative to releasably anchor said guide bar lower end to said stake against axial shifting and angular displacement relative thereto.

7. The stake driver of claim 1 including upright stake means including upper and lower ends, said stake means upper end including mounting means defining an upwardly opening socket in which said lower end of said bar is removably secured.

8. The stake driver of claim 7 wherein said stake means is cylindrical.

9. The stake driver of claim 7 wherein said stake means comprises an angle member.

10. The stake driver of claim 7 wherein said stake means comprises a planar stake.

11. The stake driver of claim 7 wherein said stake means includes a stake element having upper and lower ends and a downwardly opening impact cap telescoped downwardly over the upper end of said stake element, said upwardly opening socket being defined on said impact cap.

12. The stake driver of claim 1 including upright stake means including upper and lower ends, said stake means upper end including mounting means defining an upwardly opening socket in which said lower end of said bar is removably secured, the upper end of said housing including central, downwardly facing, compressible impact absorbing means disposed between said abutment and the upper end of said guide bar, said impact absorbing means being only partially fully compressed when said downwardly facing abutment surface means is contacted with said stake means upper end.

13. The stake driver of claim 1 wherein said housing includes opposite side outwardly projecting handle means.

14. The stake driver of claim 1 wherein said guide bar and housing include first coacting means preventing relative rotation between said guide bar and housing.

15. The stake driver of claim 1 including a set screw slidingly received through one side of said housing centrally intermediate its upper and lower ends and threadedly received through the adjacent wall of said guide sleeve below said guide plate an releasably engaged with said guide bar for releasably locking said guide bar in position relative to said guide sleeve.

16. The stake driver of claim 1 wherein the upper end of said guide bar including a diametrically enlarged abutment engagable with said guide plate from above to limit upward displacement of said housing relative to said guide bar to a position with said guide bar extending fully through said guide sleeve, to thereby ensure full guiding action of said guide sleeve on said guide bar at all times and to also enable upward impact of said guide plate, upon upward displacement of said housing relative to said guide bar, to the upper position of said housing relative to said guide bar to assist in upward withdrawal of an associated stake means removably anchored to the lower end of said guide bar.

* * * * *